US006282929B1

(12) United States Patent
Eller et al.

(10) Patent No.: US 6,282,929 B1
(45) Date of Patent: Sep. 4, 2001

(54) MULTIPOINT MORTISE LOCK

(75) Inventors: Darren C. Eller, East Lyme; Bryce A. Fleury, Glastonbury; Dan S. Leiper, Milford; Todd C. Zimmer, Meriden, all of CT (US)

(73) Assignee: Sargent Manufacturing Company, New Haven, CT (US)

( * ) Notice: Subject to any disclaimer, the term of this patent is extended or adjusted under 35 U.S.C. 154(b) by 0 days.

(21) Appl. No.: 09/499,524

(22) Filed: Feb. 10, 2000

(51) Int. Cl.[7] ..... E05B 59/00

(52) U.S. Cl. ..... 70/109; 70/107; 70/450; 292/32

(58) Field of Search ..... 70/107–109, 110, 70/450, 92; 292/32–36, 24–26, 92

(56) References Cited

U.S. PATENT DOCUMENTS

| | | | | |
|---|---|---|---|---|
| 444,730 | | 1/1891 | Shinn . | |
| 1,346,670 | | 7/1920 | Page | 292/92 X |
| 1,850,222 | | 3/1932 | Carlson . | |
| 2,019,528 | | 11/1935 | Ellison | 292/92 X |
| 2,029,901 | | 2/1936 | Voight | 292/92 |
| 2,056,537 | | 10/1936 | Schatzlein | 292/92 X |
| 2,505,190 | | 4/1950 | Kulbersh | 292/92 X |
| 2,594,253 | | 4/1952 | Vander Veer | 292/92 |
| 3,621,686 | | 11/1971 | Klein | 70/157 |
| 3,819,213 | | 6/1974 | Vanderburgh | 70/92 X |
| 3,950,974 | * | 4/1976 | Alexander | 70/450 |
| 4,096,719 | * | 6/1978 | Tranberg | 70/450 |
| 4,099,753 | | 7/1978 | Gwozdz et al. | 292/177 |
| 4,283,882 | | 8/1981 | Hubbard et al. | 292/21 X |
| 4,311,329 | | 1/1982 | Kral | 292/92 |
| 4,961,330 | | 10/1990 | Evans | 292/21 |
| 4,989,428 | * | 2/1991 | Prevot | 70/450 X |
| 5,061,022 | | 10/1991 | Meriwether | 292/33 X |
| 5,265,920 | * | 11/1993 | Kaup et al. | 70/110 X |
| 5,301,525 | * | 4/1994 | Doring | 70/110 X |
| 5,373,716 | * | 12/1994 | MacNeil et al. | 70/109 |
| 5,495,731 | * | 3/1996 | Riznik | 292/39 X |
| 5,498,038 | | 3/1996 | Simon et al. | 292/36 |
| 5,588,686 | | 12/1996 | Riley et al. | 292/92 |
| 5,678,870 | | 10/1997 | Pelletier | 292/244 |
| 5,765,410 | * | 6/1998 | Kwan et al. | 70/107 |
| 5,782,114 | * | 7/1998 | Zeus et al. | 70/109 |
| 5,819,562 | * | 10/1998 | Christ | 70/107 |
| 5,878,605 | * | 3/1999 | Renz | 70/107 |
| 6,050,115 | * | 4/2000 | Schroter et al. | 70/107 |
| 6,068,304 | * | 5/2000 | Lindqvist | 292/32 X |
| 6,094,869 | * | 8/2000 | Magoon et al. | 70/450 X |

* cited by examiner

*Primary Examiner*—Suzanne Dino Barrett
(74) *Attorney, Agent, or Firm*—DeLio & Peterson, LLC

(57) ABSTRACT

A multipoint mortise lock assembly includes an extended face piece mounted flush along the edge of a door, a mortise lock connected to the face piece, and a pair of hook bolt latch mechanisms mounted to the face piece above and below the mortise lock. An elongated actuator, which is preferably a flat rod slidingly mounted to the back of the face piece, acts to extend and retract the hook bolts in synchronism with a deadbolt in the mortise lock. The actuator is connected between a deadbolt arm in the mortise lock, which drives the deadbolt, and the hook bolt latch mechanisms. The deadbolt arm is driven conventionally, such as by a key or a thumb latch, and the design allows one hand operation of the multipoint mortise lock assembly.

19 Claims, 4 Drawing Sheets

MULTIPOINT MORTISE LOCK

BACKGROUND OF THE INVENTION

1. Field of the Invention

The present invention relates to mortise locks that extend multiple bolts outward from a door edge and into latching engagement with an adjacent surface, such as an adjacent door frame. More specifically, the present invention relates to mortise lock assemblies that include a central mortise lock having a deadbolt that extends outward from a face piece mounted to the edge of a door and at least one latch mechanism having a latching bolt, preferably a hook bolt, which also extends outward from the face piece to engage the adjacent surface.

2. Description of Related Art

Mortise locks are designed to be mortised into the edge of a door and typically include a spring loaded latchbolt with a beveled edge that latches into an opening in an adjacent surface when the door is closed. The adjacent surface may be a door frame or the edge of another door. In addition to the latchbolt, mortise locks usually include an integrated deadbolt that can also be extended outward from the mortise lock to latch into the adjacent surface.

In most modern mortise lock designs, the deadbolt can be extended or retracted by turning a key in a cylinder lock on one side of the door, or by rotating a thumb latch on the other side. The deadbolt may also be connected to the latchbolt retraction linkage between a handle and the latchbolt. When the door is locked, rotating the handle will retract the latchbolt and simultaneously retract the deadbolt.

An improved type of mortise lock used in high security applications is a multipoint mortise lock assembly. A multipoint mortise lock assembly includes an elongated vertical face piece that is attached to the front of the mortise lock case. One or more additional latch mechanisms are also attached to the face piece and are operably connected to the mortise lock. The additional latch mechanisms include latching bolts that can be extended outward from the face piece and into latching engagement with the opposing door frame or adjacent door.

For maximum security, the additional latch mechanisms are constructed with hook bolts which hook into openings in the opposing door frame when they are extended. This hooking action prevents the adjacent door frame from being separated from the face piece on the mortise lock assemble until the hook bolts are withdrawn.

Multipoint mortise lock mechanisms of this type have heretofore required that the lock be operated with two hands to extend the hook bolts. One hand is required to rotate the key, and a second hand is required to operate the hook latches. The hook latches are usually operated by rotating the handle, typically a lever handle, at the same time that the key is held in a selected position that permits the extension of the hook bolts. Two-handed operation, however, is inconvenient and the correct manner of operating the lock may not be immediately apparent to the user.

Bearing in mind the problems and deficiencies of the prior art, it is therefore an object of the present invention to provide a multipoint mortise lock assembly that can be operated with one hand.

It is another object of the present invention to provide a multipoint mortise lock assembly that may be mounted to a door having a beveled edge.

A further object of the present invention is to provide a multipoint mortise lock assembly that can be operated by existing trim and handle mechanisms.

Still another object of the present invention is to provide a multipoint mortise lock assembly that is easy to operate and which operates in substantially the same manner as conventional mortise locks having only a latchbolt and a deadbolt.

Still other objects and advantages of the invention will in part be obvious and will in part be apparent from the specification.

SUMMARY OF THE INVENTION

The above and other objects, which will be apparent to those skilled in art, are achieved in the present invention which is directed to a multipoint mortise lock assembly for mounting in an edge of a door including an elongated face piece, a mortise case connected to the face piece, and at least one latch mechanism mounted to the face piece. Each latch mechanism includes a latching bolt that can be extended outward from the face piece into a latched position, or retracted inward to an unlatched position.

A deadbolt is movably mounted in the mortise case for motion between an extended position and a retracted position and also extends outward from the face piece when in the extended position. The deadbolt is driven between the extended position and the retracted position by a deadbolt arm mounted in the mortise case. At least one elongated actuator is connected between the at least one latch mechanism and the deadbolt arm, the elongated actuator moving the latching bolt to the latched position whenever the deadbolt arm drives the deadbolt to the extended position.

In the preferred embodiment of the invention the elongated actuator is a flat rod mounted in sliding contact with and substantially parallel to the face piece.

In another aspect of the invention the mortise case is connected to the face piece with a pivoting connection which allows the face piece to be pivoted relative to the mortise case. This lets the face piece be attached flush against a door edge when the door edge is beveled. In this embodiment of the invention, the actuator is loosely connected to a link, and the link is loosely connected to the deadbolt arm, to allow relative movement between the actuator and the deadbolt arm as the mortise case is pivoted relative to the face piece.

To drive the actuator, it is preferred for the actuator to have an extended actuating arm projecting out approximately perpendicular to the actuator and connected to a link which is connected to the deadbolt arm.

In the most highly preferred embodiment of the invention, the multipoint mortise lock assembly includes an elongated face piece, a mortise case connected to the face piece, and first and second hook bolt latch mechanisms mounted to the face piece at points above and below the mortise case. The latch mechanisms include corresponding first and second hook bolts mounted in the latch mechanisms for motion between latched position and unlatched positions, with the hook bolts extending outward from the face piece in the latched position. A deadbolt is slidably mounted in the mortise case and a deadbolt arm is also mounted in the mortise case for driving the deadbolt between extended and retracted positions. A link is connected to the deadbolt arm and an elongated actuator is slidably mounted to face piece and operably connected to the first and second hook bolt latch mechanisms and the link. The elongated actuator moves the first and second hook bolts to the latched position when the deadbolt arm drives the deadbolt to the extended position.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS

In describing the preferred embodiment of the present invention, reference will be made herein to FIGS. 1–6 of the drawings in which like numerals refer to like features of the invention.

Figure 1:
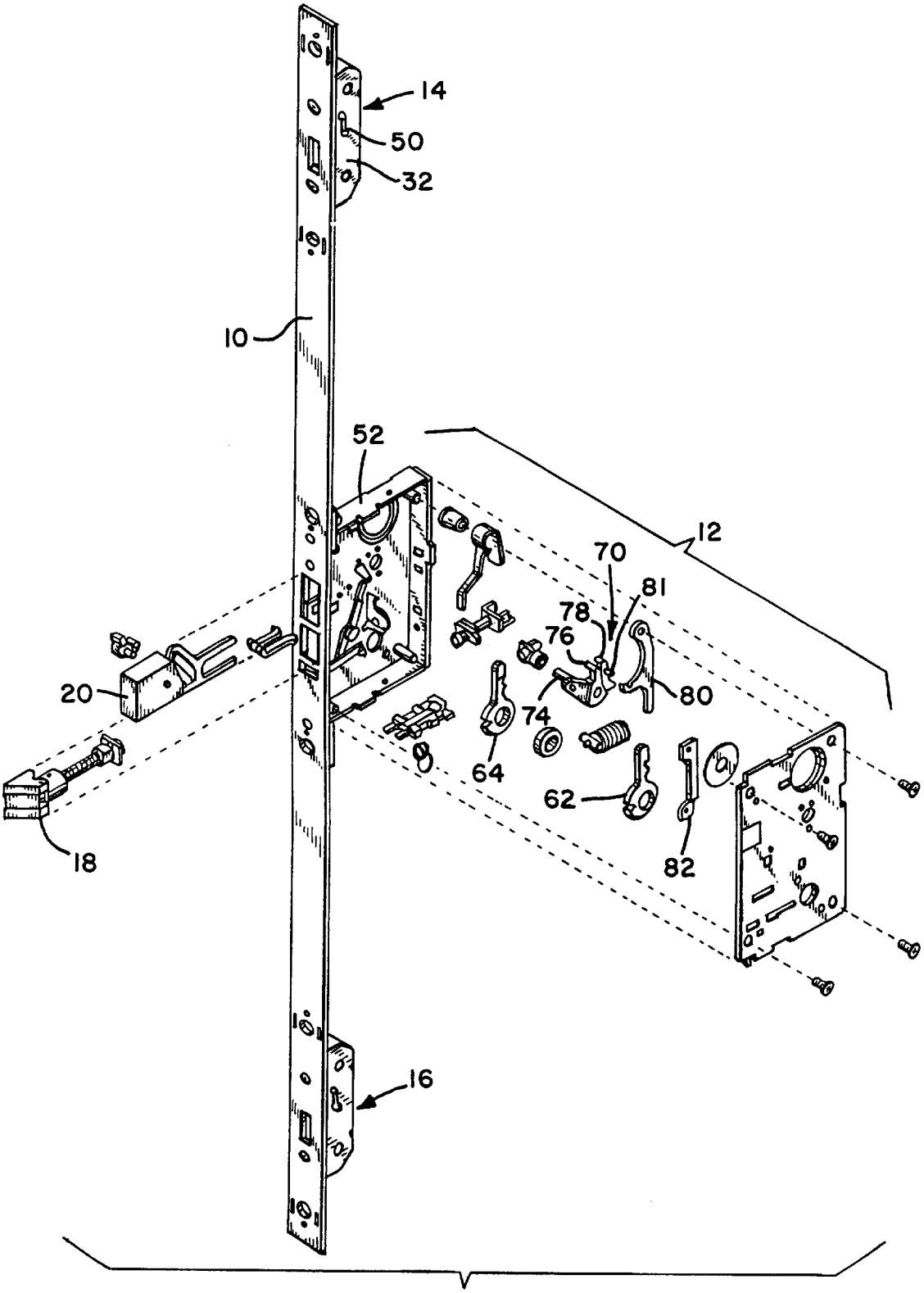
FIG. 1 is a partially exploded perspective view taken from the right front side of the complete multipoint mortise lock assembly of the present invention.

Referring to FIG. 1, the present invention includes an elongated face piece 10 adapted to be mounted to the edge of the door. A mortise lock mechanism 12 and a pair of latch mechanisms 14, 16 are mounted to the face piece 10. The mortise lock 12 includes a latchbolt 18 and a deadbolt 20. The latchbolt 18 operates conventionally. It is spring loaded and includes a beveled front edge which allows the latchbolt to be pushed back into the retracted position automatically as the door swings closed.

Figure 3:
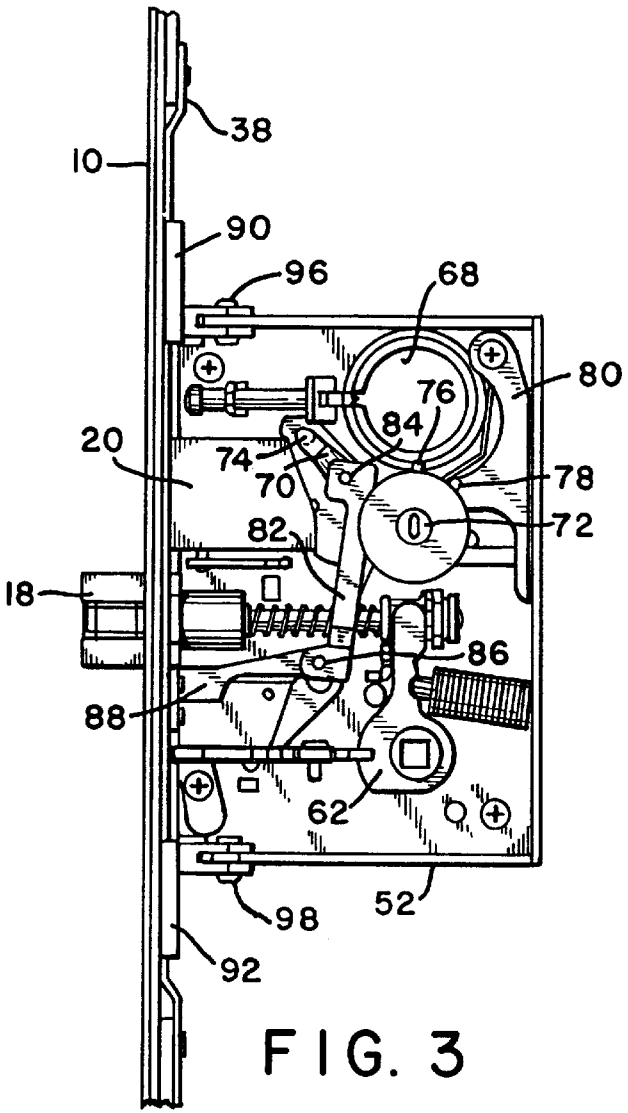
FIG. 3 is also a side elevational view of the mortise lock portion of the present invention and shows the assembled components therein as seen in FIG. 2, except that the deadbolt is shown in the retracted position.
Figure 2:
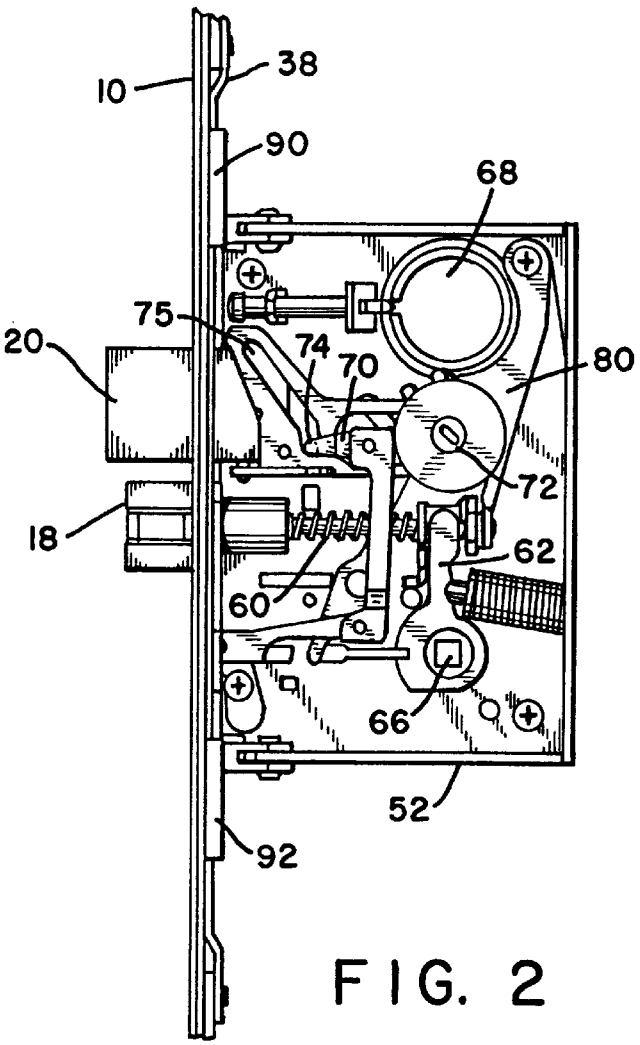
FIG. 2 is a right side elevational view of the mortise lock portion of the present invention seen in FIG. 1. The mortise lock is shown with the deadbolt in the extended position and with the cover removed from the mortise lock case to show the assembled components therein.

FIG. 1 shows the complete multipoint mortise lock assembly of this invention. The central mortise lock portion 12 of the assembly is shown in an exploded view and the latch mechanisms 14, 16 are shown assembled. FIGS. 2 and 3 show only the central mortise lock portion 12 of the mortise lock assembly, but show the components therein in their assembled relationship, with FIG. 2 showing the deadbolt 20 extended and FIG. 3 showing the deadbolt 20 retracted.

Figure 4:
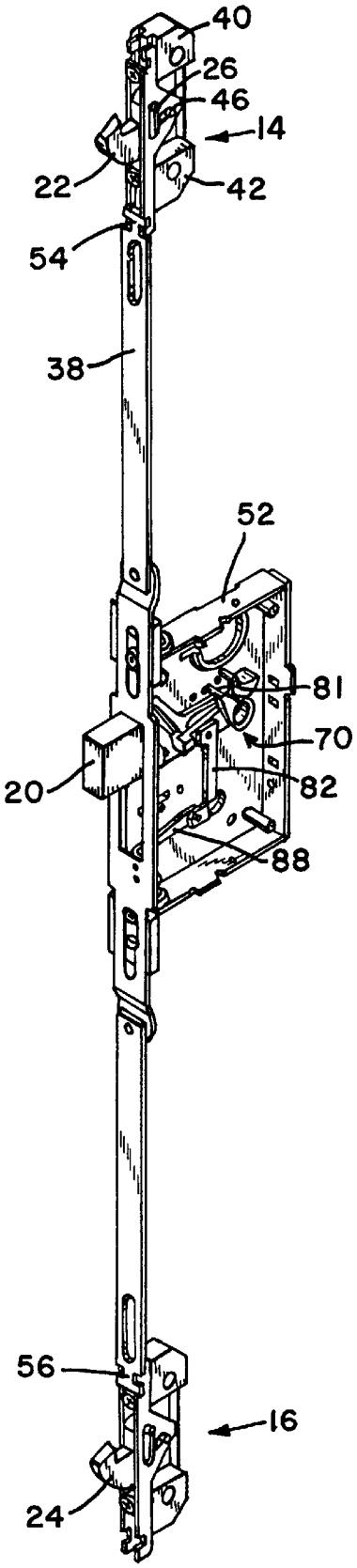
FIG. 4 is a perspective view taken from the right front side of the multipoint mortise lock assembly of the present invention. The mortise lock cover, covers on the hook bolt latch mechanisms, the face piece and portions of the mortise lock mechanism have been omitted to show the important components operably connecting the hook bolt latch mechanisms to the deadbolt of the mortise lock. The hook bolt latch mechanisms and the mortise lock are shown in the extended position.
Figure 6:
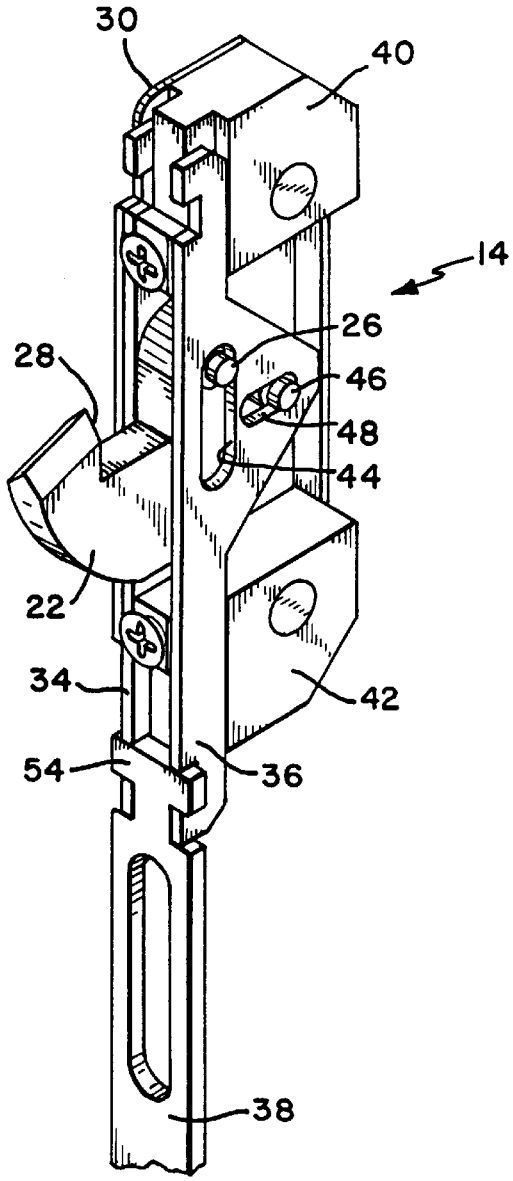
FIG. 6 is a detailed perspective view of the hook bolt latch mechanisms seen in FIG. 4. As in FIG. 4, the face piece and the cover for the case of the hook bolt latch mechanisms have been omitted for clarity.
Figure 5:
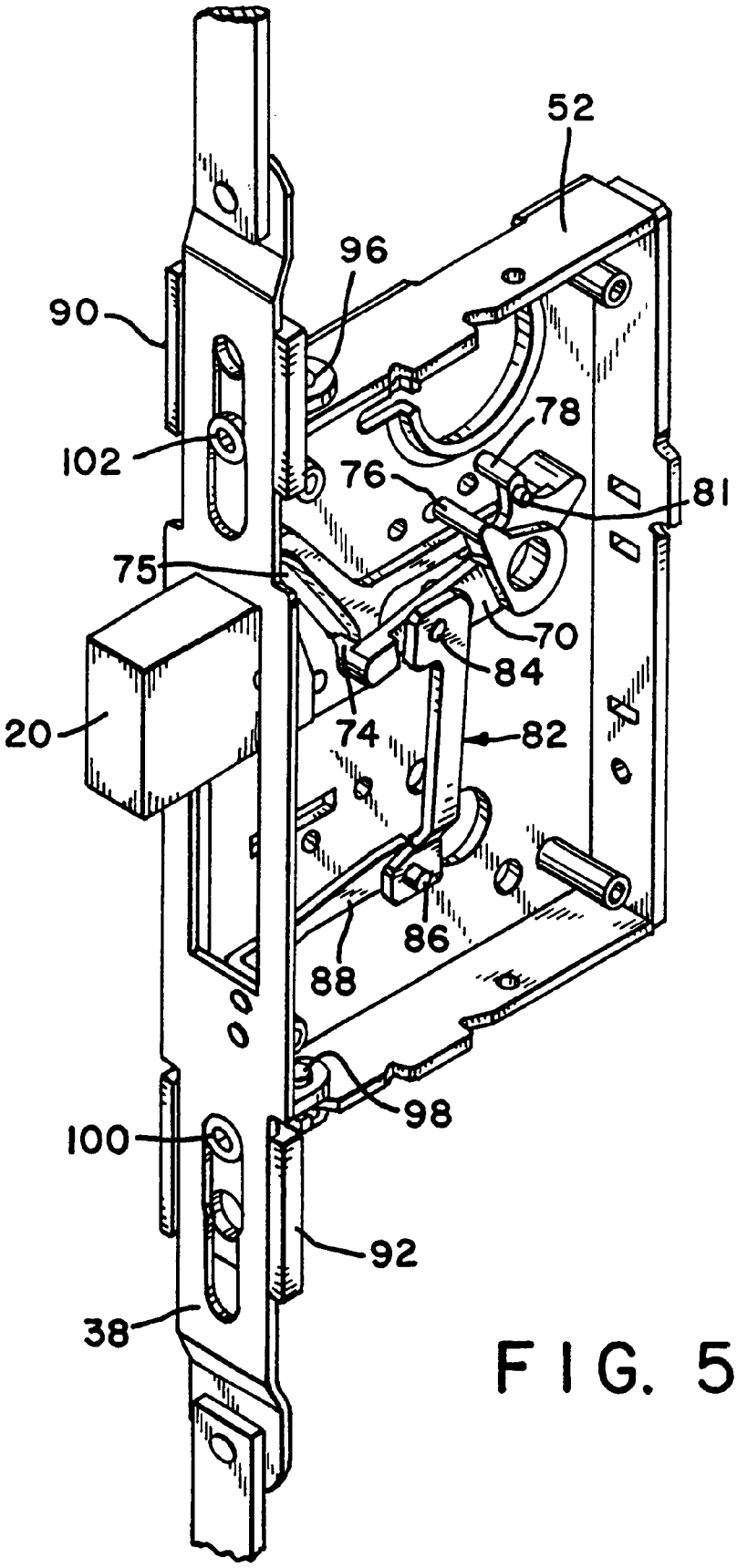
FIG. 5 is a detailed perspective view corresponding to FIG. 4 showing important components of the mortise lock mechanism of the present invention. As in FIG. 4, portions of the mortise lock assembly, including the latchbolt and face piece, have been omitted to better illustrate the operation of the deadbolt mechanism an its connection to the hook bolt latch mechanisms.

To show the relationship of the internal components, FIGS. 4, 5 and 6 have omitted the covers for the central mortise lock 12, as well as the covers on the latch mechanisms 14, 16. Other conventional components in the central mortise lock 12, relating to the operation of the latchbolt 18, have also been omitted from FIGS. 4 and 5 to better show the novel elements of this invention which interconnect the deadbolt 20 and the latch mechanisms 14, 16.

FIGS. 4, 5 and 6 show the deadbolt 20 and the latching bolts 22, 24 in the extended position. The latching bolts 22, 24 form part of the latch mechanisms 14, 16 and move outward from the face piece 10 in the same general direction as the deadbolt 20 and the latchbolt 18 to engage corresponding openings in an adjacent surface, such as an adjacent door frame or door.

The latching bolts 22, 24 in the latch mechanisms 14, 16 may be arranged to move directly in and out perpendicular to the adjacent surface they are to latch into by sliding in a manner similar to the sliding extension and retraction of deadbolt 20. However, in the preferred design the latching bolts 22, 24 are hook bolts that move by swinging into a hooking engagement with the door frame surface that is adjacent to face piece 10 when the door is closed.

As may be seen best in FIG. 6, the upper hook bolt 22 pivots about pivot pin 26. Pivot pin 26 is pivoted in corresponding pivot holes in opposed sides 30, 32 of the latch mechanism 14. (Refer to FIG. 1 to see side 32 which has been removed from FIG. 4.) The pivoting action of hook bolt 22 allows the hook bolt to swing into a corresponding opening in the opposing door frame. This allows latching surface 28 on the hook bolt to engage the opposing surface which prevents the upper and lower latch mechanisms 14, 16 from being separated from that surface until the hook bolts are retracted.

Continuing to refer to FIG. 6, it can be seen that pivot pin 26 includes ends with a reduced diameter corresponding to the diameter of pivot holes in sides 30, 32 which capture the pivot pin 26. Latching bolt 22 is moved on pivot 26 by opposed sliding driver pieces 34, 36, which slide vertically just inside opposed sides 30, 32. The opposed sliding drivers 34, 36 are captured inside the opposed sides 30, 32 and are driven vertically up and down by actuator 38, which connects to the deadbolt actuating mechanism inside central mortise lock 12.

FIG. 6 shows the sliding drivers 34, 36 pulled downwards to the maximum position, which extends the hook latching bolt 22. Sliding drivers 34, 36 move within the case of the latch mechanism 14 formed by opposed sides 30, 32, which are mounted to case blocks 40, 42. Notches in the case blocks 40, 42 act to guide the sliding drivers 34, 36 as they move vertically relative to the case blocks.

The axis of pivot pin 26 remains stationary relative to sides 30, 32 and case blocks 40, 42 as the sliding drivers 34, 36 move down. Vertical slot 44 allows the sliding drivers to move relative to pivot pin 26 which extends through the drivers and into the sides 30, 32. Driver pin 46, however, is captured within horizontal slot 48 in driver 36, and in a corresponding slot in driver 34, so that it moves with the sliding drivers 34, 36 as they are moved vertically by actuator 38. Driver pin 46 also has ends with a reduced diameter, similar to pivot pin 26, and these ends are captured within a curved slot 50 in side 32 (see FIG. 1) and in a corresponding curved slot in opposed side 30.

As can be seen in FIG. 4 actuator 38 is a flat rod mounted in front of the case 52 for the mortise lock and behind the face piece 10. Actuator 38 may be a single piece or it may be constructed as multiple pieces as shown in FIG. 4. The actuator is preferably held adjacent to, and in sliding contact with, face piece 10 by one or more capture brackets, such as brackets 90, 92 seen in FIGS. 2 and 3. The capture brackets are approximately U-shaped and capture the actuator 38 against the face piece.

It can also be seen in FIG. 4 that the upper latch mechanism 14 is identical to lower latch mechanism 16, and that the two latch mechanisms are oriented in the same direction, not in a mirror image relationship. The opposite ends of the actuator 38 are provided with T-connections 54, 56, which engage corresponding notches formed on the opposite ends of the sliding drivers 34, 36. This design permits the upper latch mechanism 14 to be driven from below while the lower latch mechanism 16 is simultaneously driven from above by a single actuator 38 that extends from top to bottom.

For extremely high security applications, the design may also be constructed with additional latch mechanisms by using multiple actuator rods, like actuator 38. The multiple actuator rods may be used to link the additional latch mechanisms in a chainlike fashion with the T-connections found on each latch mechanism. The upper or lower latch mechanism may also be eliminated if desired.

FIGS. 2 and 3 show the assembled mortise lock with the deadbolt in the extended and retracted positions respectively. The operation of the latchbolt 18 is substantially conventional and will be described first. The latchbolt is held in the extended position with spring 60. Spring 60 allows the latchbolt 18 to be pushed back into the mortise lock as the door closes by the beveled edge on the latchbolt. After the door is closed, the latchbolt must be retracted to open the door, and this is accomplished by rotating either one of a pair of spindle hubs 62, 64 (also see FIG. 1). The spindle hubs are rotated by corresponding inner and outer handles (not shown). The handles are connected to the spindle hubs via square spindle shafts. The square spindle shaft from each handle engages a corresponding spindle hole in a corresponding one of spindle hubs 62, 64. Spindle hub 62 includes square spindle hole 66.

Separate spindle hubs 62, 64 are provided so that inner and outer handles may be operated and locked independently. Locking is accomplished via a conventional cylinder lock and cylinder lock hole 68 is provided to receive such a lock. A suitable cylinder lock is operated by a key to rotate the locking cylinder. The locking cylinder includes a lock arm which contacts deadbolt arm 70 and rotates it about shaft 72. When deadbolt arm 70 rotates about shaft 72, the deadbolt 20 is extended or retracted.

Shaft 72 is provided with a slot adapted to receive a shaft from a conventional thumb latch. The thumb latch can be used to directly turn shaft 72 so that the deadbolt 20 may also be extended or retracted by rotating the deadbolt arm. Deadbolt arm 70 includes a pin 74 at one end thereof, and two tabs 76, 78. Pin 74 rides within diagonal slot 75 in the deadbolt. As may be seen in FIG. 2, with the deadbolt arm rotated counter clockwise, the pin 74 at the end of the deadbolt arm rides to the bottom of slot 75 and extends deadbolt 20. As may be seen in FIG. 3, when the deadbolt arm 70 is rotated clockwise, the pin 74 rides to the top of slot 75 and retracts deadbolt 20.

As described above, the deadbolt arm 70 may also be rotated by rotating a cylinder lock located within cylinder lock opening 68. The cylinder lock includes a lock arm that contacts tab 76 when rotated on one direction and tab 78 when rotated in the opposite direction. This contact rotates the deadbolt arm 70 about shaft 72 and drives the deadbolt between the extended and retracted positions.

Rotation of the deadbolt arm 70 by either the lock cylinder or the thumb latch also acts to conventionally lock or unlock mortise lock 12. Other functions may also be incorporated into the mortise lock in a conventional manner for particular applications of the lock.

A third method by which the deadbolt arm 70 may be rotated is through auto-retract lever 80. When spindle hub 62 rotates, it retracts the latchbolt 18 in a conventional manner. The retraction of latchbolt 18 causes the tail of the latchbolt to contact auto retract lever 80. Auto retract lever 80 is connected to pin 81 on tab 78. As the auto retract lever 80 is pushed back, it pulls on pin 81 on tab 78 thereby rotating the deadbolt arm 70 clockwise around shaft 72 and automatically retracting the deadbolt 20.

The operation described above of the mortise lock, specifically including the latchbolt 18, the deadbolt arm 70 and the corresponding motion of the deadbolt 20 is all entirely conventional and is based upon the 7800 and 8200 mortise locks available from Sargent Manufacturing Company of New Haven, Conn. The deadbolt arm 70 has been changed, however, and the face piece 10, latch mechanisms 14, 16 and other internal components have been modified or added to provide the improved security and simple operation characteristics of the present invention.

Any of the three methods described above (cylinder lock, thumb latch or auto retract lever) may be used to retract the deadbolt. However, in each case it can be seen that motion of the deadbolt arm 70 is required to extend or retract the deadbolt 20. The present invention avoids the necessity for separate actuation systems for the hook bolt latch mechanisms by using this motion of the deadbolt arm 70 to also drive the latch mechanisms 14, 16 through actuator 38.

This allows the lock to be operated with one hand and ensures that the upper and lower hook bolt latch mechanisms 14, 16 move with the deadbolt between the extended and retracted positions. This design also simplifies the operation of the multipoint lock for a user, because any user familiar with a prior art type of mortise lock, will also be able to operate the multipoint lock system in the same way without needing to be shown a separate activation method to operate the hook latch mechanisms.

To achieve this simplicity of operation, the deadbolt arm 70 is connected to a link 82 which is pivotally connected at its upper end via pin 84 to the deadbolt arm 70 and at its lower end via pin 86 to an actuating arm 88. Actuating arm 88 is rigidly and permanently connected to actuator 38 and is used to slide the actuator 38 vertically to operate the latch mechanisms. The actuating arm 88 extends outward approximately perpendicular to the plane of the actuator 38 as can be seen most clearly in FIG. 5.

Link 82 is not directly connected to the case of the mortise lock 12 at any point, but is captured between the deadbolt arm 70 and the actuating arm 88 on pins 84, 86. The actuator 38 is held in sliding contact with face piece 10 via capture brackets 90, 92. The capture brackets 90, 92 are pivotally connected to the mortise case 52 on pivot pins 96, 98. The pivoting connection between the mortise lock 12 and the face piece 10 provided by pivot pins 96, 98 allows the face piece 10 to be attached to the edge of the door even when the edge of the door is beveled. The face piece 10 is permanently attached to capture brackets 90, 92 with screws that engage threaded openings 100, 102.

It will be noted that actuating arm 88, which is rigidly attached to the actuator 38, will move from side to side as the face piece 10 and actuator 38 rotate about pivot pins 96, 98. The motion of actuating arm 88 from side to side is accentuated at pin 86, which connects the arm 88 to the link 82, and moves actuating arm 88 so that it lies at an angle to the plane of rotation of deadbolt arm 70.

To accommodate this angular difference, the pin connections 84, 86 between the link 82, the actuating arm 88 and the deadbolt arm 70, are constructed with significant mechanical play to allow the deadbolt arm 70 to drive the actuating arm 88 without binding.

From the description provided above it will be seen that the interconnection between the deadbolt arm 70 and the actuator 38 through link 82 ensures that whenever the deadbolt 20 is extended, the hook bolts 22 and 24 will also be extended, and whenever the deadbolt is retracted, the hook bolts will also be retracted.

The present design allows all of the available handles and external trim components to be used with this invention because the thumb latch, spindle shaft openings and the cylinder lock opening all are located in the same relative positions as found in the prior art, and all operate in the same way. Further, the basic operation of the latchbolt 18, as well as the way it interacts with the deadbolt and the cylinder lock mechanism are unchanged. Accordingly the remaining components of the mortise lock seen in FIG. 1, as well as in FIGS. 2, 3 are not described in detail. These components generally include biasing springs, devices for holding the cylinder lock in position, bushings and washers, all of which are well known to those of skill in the art, and all of which operate in a conventional manner.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A multipoint mortise lock assembly for mounting in an edge of a door comprising:

an elongated face piece for mounting to the edge of the door;

a mortise case connected to the face piece;

at least one latch mechanism mounted to the face piece at a distance from the mortise case, the latch mechanism including a latching bolt mounted in the latch mechanism for motion between a latched position and an unlatched position, the latching bolt extending outward from the face piece in the latched position;

a deadbolt movably mounted in the mortise case for motion between an extended position and a retracted position, the deadbolt extending outward from the face piece in the extended position;

a deadbolt arm mounted in the mortise case for driving the deadbolt, the deadbolt arm and deadbolt being drivable by a lock arm on a cylinder lock to move the deadbolt between the extended position and the retracted position;

at least one elongated actuator connected between the at least one latch mechanism and the deadbolt arm, the elongated actuator moving the latching bolt to the latched position whenever the deadbolt arm drives the deadbolt to the extended position.

2. The multipoint mortise lock assembly according to claim 1 wherein the at least one elongated actuator is slidably connected to the elongated face piece.

3. The multipoint mortise lock assembly according to claim 2 wherein the face piece is flat and the at least one elongated actuator comprises a flat rod mounted in sliding contact with and substantially parallel to the face piece.

4. The multipoint mortise lock assembly according to claim 1 wherein the mortise case is connected to the face piece with a pivoting connection whereby the face piece may be pivoted relative to the mortise case to accommodate the edge of the door when the edge of the door is beveled.

5. The multipoint mortise lock assembly according to claim 4 wherein the at least one elongated actuator is connected to a link, and the link is connected to the deadbolt arm, the deadbolt arm driving the link to move the at least one elongated actuator and the link allowing relative movement between the elongated actuator and the deadbolt arm as the mortise case is pivoted relative to the face piece.

6. The multipoint mortise lock assembly according to claim 1 wherein the latching bolt is a hook bolt.

7. The multipoint mortise lock assembly according to claim 1 further including a second latch mechanism mounted to the face piece, the second latch mechanism including a second latching bolt connected to the elongated actuator, the elongated actuator moving the second latching bolt to the latched position in synchronism with the first latching bolt whenever the deadbolt arm drives the deadbolt to the extended position.

8. The multipoint mortise lock assembly according to claim 1 further including a link connected to the deadbolt arm and wherein the elongated actuator includes an extended actuating arm connected to the link, the deadbolt arm driving the link and the link driving the actuating arm to move the actuator and operate the latch mechanism.

9. The multipoint mortise lock assembly according to claim 8 wherein the link is not directly attached to the mortise case.

10. The multipoint mortise lock assembly according to claim 8 wherein the elongated actuator is substantially flat and the actuating arm extends outward approximately perpendicular to the elongated actuator.

11. The multipoint mortise lock assembly according to claim 8 wherein the link is attached to the actuating arm and to the deadbolt arm with mechanical play sufficient to allow relative pivoting motion between the actuating arm and the deadbolt arm.

12. The multipoint mortise lock assembly according to claim 1 wherein the at least one elongated actuator is a flat rod slidably connected to the elongated face piece.

13. The multipoint mortise lock assembly according to claim 12 wherein the at least one elongated actuator is slidably held to the back of the elongated face piece between the face piece and the mortise case.

14. The multipoint mortise lock assembly according to claim 1 having one elongated actuator extending upwards and downwards from the mortise case and two latch mechanisms positioned above and below the mortise case, the latch mechanisms being oriented in the same direction and not in a mirror image relationship.

15. A multipoint mortise lock assembly for mounting in an edge of a door comprising:

an elongated face piece for mounting to the edge of the door;

a mortise case connected to the face piece;

first and second hook bolt latch mechanisms mounted to the face piece at points above and below the mortise case, the latch mechanisms including corresponding first and second hook bolts mounted in the latch mechanisms for motion between a latched position and an unlatched position, the hook bolts extending outward from the face piece in the latched position;

a deadbolt slidably mounted in the mortise case for motion between an extended position and a retracted position, the deadbolt extending outward from the face piece in the extended position;

a deadbolt arm mounted in the mortise case for driving the deadbolt, the deadbolt arm and deadbolt being drivable by a lock arm on a cylinder lock to move the deadbolt between the extended position and the retracted position;

a link connected to the deadbolt arm;

an elongated actuator slidably mounted to face piece and operably connected to the first and second hook bolt latch mechanisms and the link, the elongated actuator moving the first and second hook bolts to the latched position when the deadbolt arm drives the deadbolt to the extended position.

16. The multipoint mortise lock assembly according to claim 15 wherein the mortise case is pivotally connected to the face piece and the link is attached to the actuating arm and to the deadbolt arm with mechanical play to allow relative pivoting motion between the mortise case and the face piece.

17. The multipoint mortise lock assembly according to claim 1 wherein the deadbolt arm includes first and second tabs drivable by a lock arm on a cylinder lock to move the deadbolt arm, the deadbolt arm driving the deadbolt between the extended position and the retracted position.

18. The multipoint mortise lock assembly according to claim 15 wherein the deadbolt arm includes first and second tabs drivable by a lock arm on a cylinder lock to move the deadbolt arm, the deadbolt arm driving the deadbolt between the extended position and the retracted position.

19. A multipoint mortise lock assembly for mounting in an edge of a door comprising:

an elongated face piece for mounting to the edge of the door;

a mortise case connected to the face piece;

first and second hook bolt latch mechanisms mounted to the face piece at points above and below the mortise case, the latch mechanisms including corresponding first and second hook bolts mounted in the latch mechanisms for motion between a latched position and an unlatched position, the hook bolts extending outward from the face piece in the latched position;

a deadbolt slidably mounted in the mortise case for motion between an extended position and a retracted position, the deadbolt extending outward from the face piece in the extended position;

a deadbolt arm mounted in the mortise case for driving the deadbolt, the deadbolt arm including first and second tabs drivable by a lock arm on a cylinder lock to move the deadbolt arm, the deadbolt arm driving the deadbolt between the extended position and the retracted position;

a link connected to the deadbolt arm;

an elongated actuator slidably mounted to face piece and operably connected to the first and second hook bolt latch mechanisms and the link, the elongated actuator moving the first and second hook bolts to the latched position when the deadbolt arm drives the deadbolt to the extended position.

* * * * *

UNITED STATES PATENT AND TRADEMARK OFFICE

CERTIFICATE OF CORRECTION

PATENT NO. : 6,282,929 B1
DATED : September 4, 2001
INVENTOR(S) : Darren C. Eller et al.

It is certified that error appears in the above-identified patent and that said Letters Patent is hereby corrected as shown below:

Column 1,
Line 46, delete "assemble" and substitute therefor -- assembly --.

Column 9, claim 15,
Line 9, after "to" insert -- the --.

Signed and Sealed this

Twenty-sixth Day of March, 2002

*Attest:*

*Attesting Officer*

JAMES E. ROGAN
*Director of the United States Patent and Trademark Office*